US006482027B2

(12) United States Patent
Ishii et al.

(10) Patent No.: US 6,482,027 B2
(45) Date of Patent: Nov. 19, 2002

(54) ELECTRICAL CONNECTOR FOR FLAT CABLES

(75) Inventors: Yoshiharu Ishii, Yokohama (JP); Sueji Shibata, Tokyo (JP); Toshio Endo, Tokyo (JP)

(73) Assignee: Yamaichi Electronics Co., Ltd., Tokyo (JP)

( * ) Notice: Subject to any disclaimer, the term of this patent is extended or adjusted under 35 U.S.C. 154(b) by 0 days.

(21) Appl. No.: 09/918,644

(22) Filed: Aug. 1, 2001

(65) Prior Publication Data

US 2002/0045381 A1 Apr. 18, 2002

(30) Foreign Application Priority Data

Oct. 13, 2000 (JP) ..... 2000-314386

(51) Int. Cl.[7] ..... H01R 12/24
(52) U.S. Cl. ..... 439/495; 439/354
(58) Field of Search ..... 439/495, 496, 439/354, 353, 358, 357

(56) References Cited

U.S. PATENT DOCUMENTS 6,010,359 A * 1/2000 Etters et al. ..... 439/496

FOREIGN PATENT DOCUMENTS

JP 7-142130 * 6/1995

* cited by examiner

*Primary Examiner*—Javaid Nasri
(74) *Attorney, Agent, or Firm*—Finnegan, Henderson, Farabow, Garrett & Dunner, LLP

(57) ABSTRACT

A flat cable connector firmly holds a flat cable in the receptacle without complicating the construction of the connector. It reliably and precisely achieves the vertical and horizontal positioning of the flat cable with respect to the contact terminals of the receptacle. The flat cable connector comprises a roughly U-shaped locking body removably attached to the ends of the flat cable and having a pair of side frames each formed with a slit and with a locking projection and a front frame connecting the front ends of the paired side frames, and a receptacle having engagement portions engaged by the locking projections, wherein the flat cable is electrically connected to the receptacle by inserting the flat cable attached with the locking body into the receptacle.

12 Claims, 13 Drawing Sheets

ELECTRICAL CONNECTOR FOR FLAT CABLES

This application is based on patent application Ser. No. 2000-314386 filed Oct. 13, 2000 in Japan, the content of which is incorporated hereinto by reference.

BACKGROUND OF THE INVENTION

1. Field of the Invention

The present invention relates to a flat cable connector for electrically connecting a flat cable of a microstrip line structure, such as FPC (flexible printed circuit) cable, to a printed circuit board.

2. Description of the Related Art

Flat cables of a microstrip line structure, such as FPC cables, are mainly used for connection between various electronic apparatus components and a printed circuit board, including connections in notebook PCs between a liquid crystal display panel and a mother board and between motherboards.

An example of conventional technology on a connector for connecting a flat cable of this kind to an apparatus is found in Japanese Patent Application Laid-open No. 7-142130.

According to this conventional technology, a plurality of contacts 101 are provided in a housing 100, as shown in FIG. 13. A lid-like pressing member 102 is rotatably provided in an opening of the housing to support a flexible circuit carrier F under pressure to lock it in the housing 100. Inserting the flexible circuit carrier F into the connector housing electrically connects contact portions of the flexible circuit carrier F with contacts 101 in the housing 100.

The conventional technology shown in FIG. 13, however, has the following drawbacks because the flexible circuit carrier F is locked under pressure by the press member 102:

the structure of the connector is complex, and the operation of inserting (and locking) the flexible circuit carrier F into the connector is not easy.

SUMMARY OF THE INVENTION

The present invention has been accomplished under these circumstances to provide a flat cable connector which, without complicating the construction of the connector, can firmly hold a flat cable in a receptacle and can also position the flat cable vertically and laterally with respect to contact terminals of the receptacle reliably and precisely.

To solve the above-described problems, one aspect of the present invention provides a flat cable connector.

In the first aspect of the present invention, there is provided a flat cable connector for electrically connecting a flat cable having contact portions of a plurality of signal lines exposed at ends of one of its surfaces, the flat cable connector comprises:

a roughly U-shaped adapter removably attached to an end of the flat cable, the adapter having a pair of side frames and a front frame connecting front ends of the paired side frames, the paired side frames each having formed at a side thereof a slit for receiving a side edge of the flat cable and a locking portion; and a receptacle having a housing securely installed therein a plurality of contact terminals adapted to engage the contact portions of the flat cable, the housing being formed with an engagement portion engaged by the locking portion and with a slot into which inserted is the flat cable attached with the adapter; and wherein the receptacle holds the flat cable attached with the adapter in the housing in such a manner that the contact portions of the flat cable engage with the plurality of contact terminals.

Here, the cable may have a conductive reinforcement plate stacked at a cable end on a surface opposite the surface where the contact portions are exposed.

The front frame of the adapter may have a thickness smaller than that of the end of the flat cable so that when the adapter is attached to the flat cable, the front frame is arranged within a range of the thickness of the end of the flat cable.

The front frame of the adapter may have a thickness smaller than that of the end of the flat cable including the reinforcement plate so that when the adapter is attached to the flat cable, the front frame is arranged within a range of the thickness of the end of the flat cable including the reinforcement plate.

The adapter may have the front frame and the side frames so sized that when the adapter is attached to the flat cable, side portions of the flat cable protrude sideways outwardly from the slits of the paired side frames.

The adapter may have the front frame and the side frames so sized that when the adapter is attached to the flat cable, side portions of the reinforcement plate and the flat cable protrude sideways outwardly from the slits of the paired side frames.

The reinforcement plate may have a width larger than that of the flat cable so that when the adapter is attached to the flat cable, side portions of the reinforcement plate protrude sideways outwardly from the slits of the paired side frames.

The reinforcement plate may have a width larger than that of the flat cable so that when the adapter is attached to the flat cable, side portions of the reinforcement plate protrude sideways outwardly from the slits of the paired side frames.

The paired side frames of the adapter each may have a grip portion protruding sideways outwardly on a proximal end side thereof, and the grip portions each have a space between them and side surfaces of the flat cable which enables the associated grip portion to move sideways when the adapter is attached to the flat cable, and wherein the locking portions of the paired side frames are unlocked from the engagement portions of the receptacle by moving the grip portions sideways.

The paired side frames of the adapter each may have a grip portion protruding sideways outwardly on a proximal end side thereof, and the grip portions each have a space between them and side surfaces of the reinforcement plate and the flat cable which enables the associated grip portion to move sideways when the adapter is attached to the flat cable, and wherein the locking portions of the paired side frames are unlocked from the engagement portions of the receptacle by moving the grip portions sideways.

The slot in the receptacle may be formed with guide grooves for guiding side edges of the flat cable attached with the adapter or for guiding side edges of the reinforcement plate for the flat cable attached with the adapter and of the flat cable.

In this invention, with the roughly U-shaped adapter, which has locking portions, attached to the flat cable, the flat cable is inserted into the receptacle having engagement portions that receive the locking portions, thereby electrically connecting the flat cable to a printed circuit board through the receptacle. The roughly U-shaped adapter can be removably attached to the flat cable.

According to one aspect of this invention, the front frame of the adapter has a thickness smaller than that of the end of the flat cable so that when the adapter is attached to the flat cable, the front frame is arranged within a range of the thickness of the end of the flat cable. The adapter also has the front frame and the side frames so sized that when the adapter is attached to the flat cable, side portions of the flat cable protrude sideways outwardly from the slits of the paired side frames. Further, the reinforcement plate has a width larger than that of the flat cable so that when the adapter is attached to the flat cable, side portions of the reinforcement plate protrude sideways outwardly from the slits of the paired side frames.

Because the side portions of the flat cable protrude sideways outwardly from the slits of the paired side frames, the horizontal positioning of the flat cable with respect to the receptacle is achieved by the side surfaces of the flat cable itself without being influenced by the adapter.

Further, because the front frame of the adapter is set smaller in thickness than the end of the flat cable to ensure that the front frame is arranged within a range of the thickness of the end of the flat cable, the vertical positioning of the flat cable with respect to the receptacle is achieved by the top and bottom surfaces of the flat cable itself without being influenced by the adapter.

This invention, therefore, can prevent a possible deterioration of positioning accuracy when the flat cable attached with the adapter is inserted into the receptacle.

With this invention, because the adapter is removably attached to the flat cable as described above, it is possible to hold the flat cable in the receptacle easily and firmly without complicating the construction of the receptacle. Further, because a locking structure is employed which exposes the side portions and the top and bottom surfaces of the flat cable to position the cable with respect to the receptacle by the side surfaces and the top and bottom surfaces of the cable itself, it is possible to prevent a possible degradation of positioning accuracy when the flat cable attached with the adapter is inserted into the receptacle. This in turn allows the contact portions of the flat cable to be positioned vertically and horizontally with respect to the contact terminals of the receptacle reliably and precisely.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Embodiments of the present invention will be described by referring to the accompanying drawings.

[First Embodiment]

The first embodiment of this invention will be described by referring to FIGS. 1 to 4.

Figure 1:
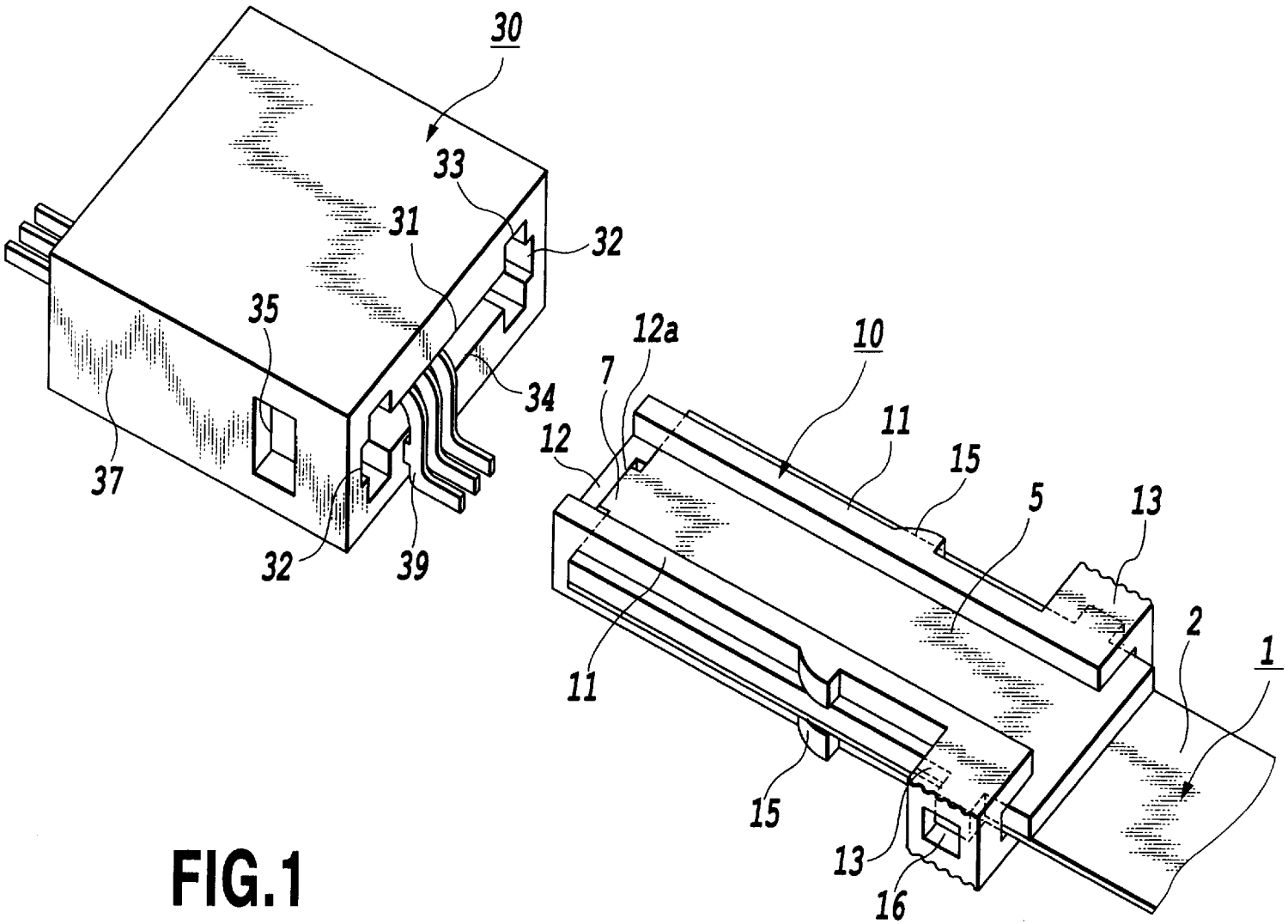
FIG. 1 is a perspective view showing an overall construction of a cable connector according to a first embodiment of the invention.
Figure 2:
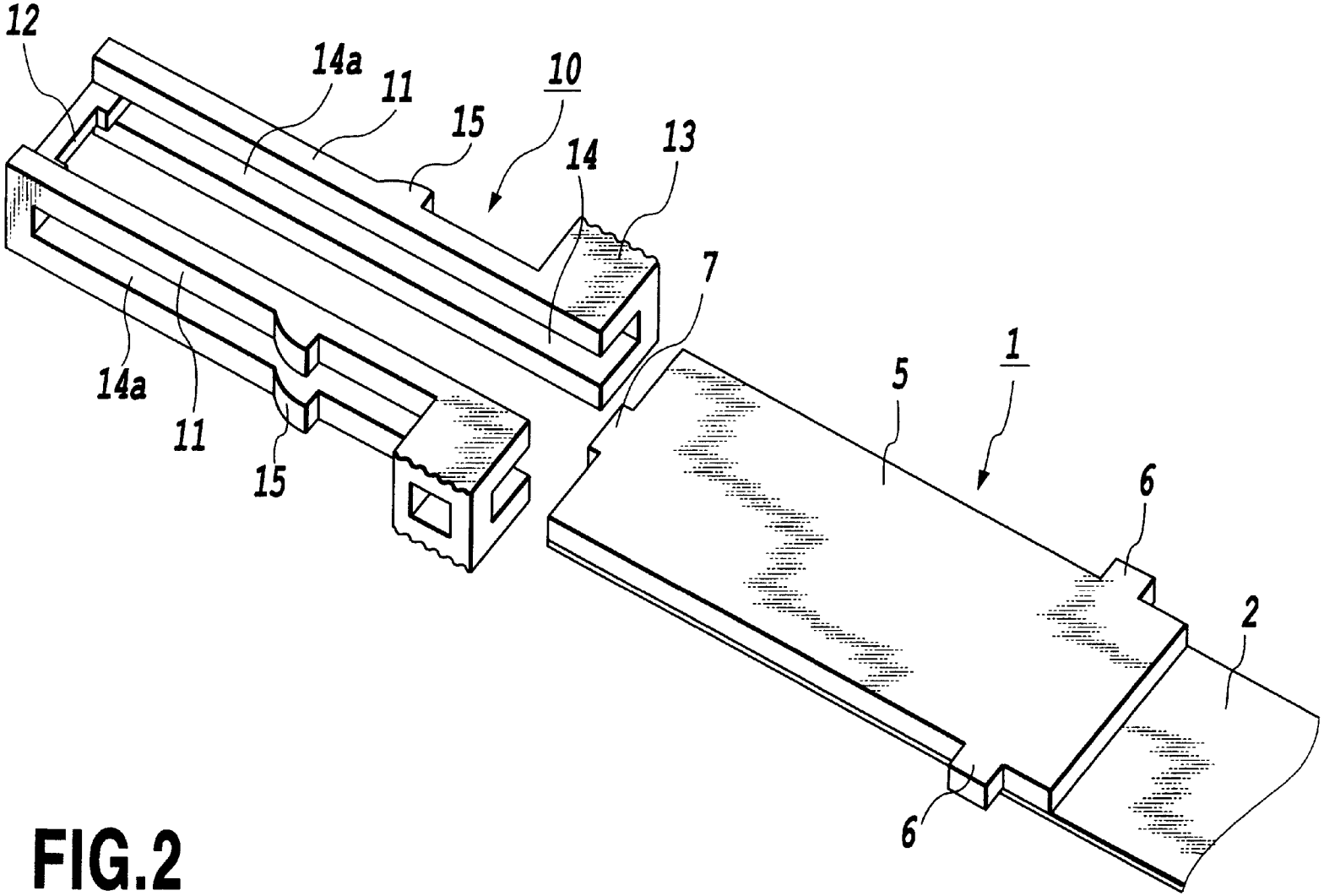
FIG. 2 is a perspective view showing a cable and a locking body in the cable connector according to the first embodiment of the invention.
Figure 3:
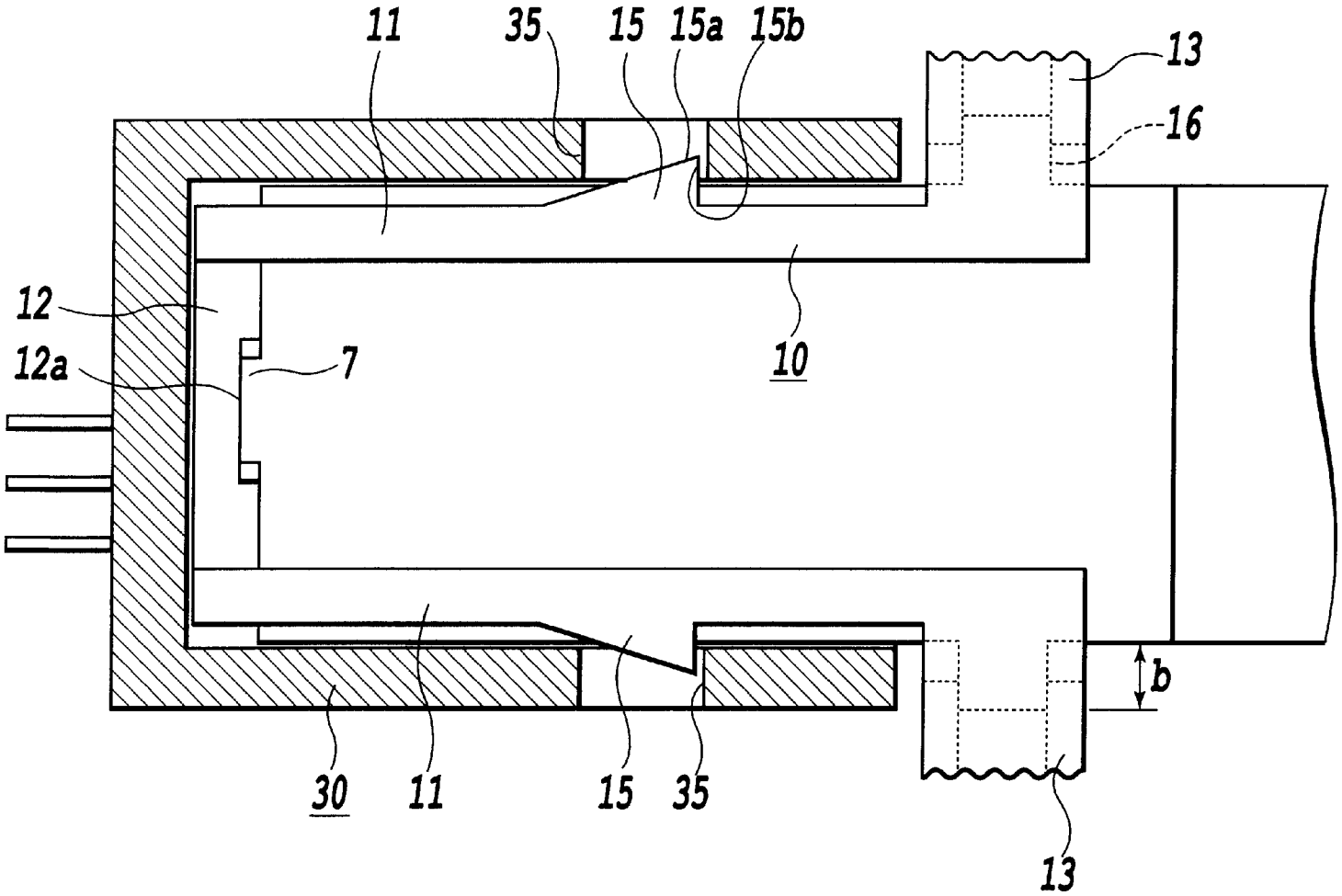
FIG. 3 is a horizontal cross section of the cable connector according to the first embodiment of the invention.
Figure 4:
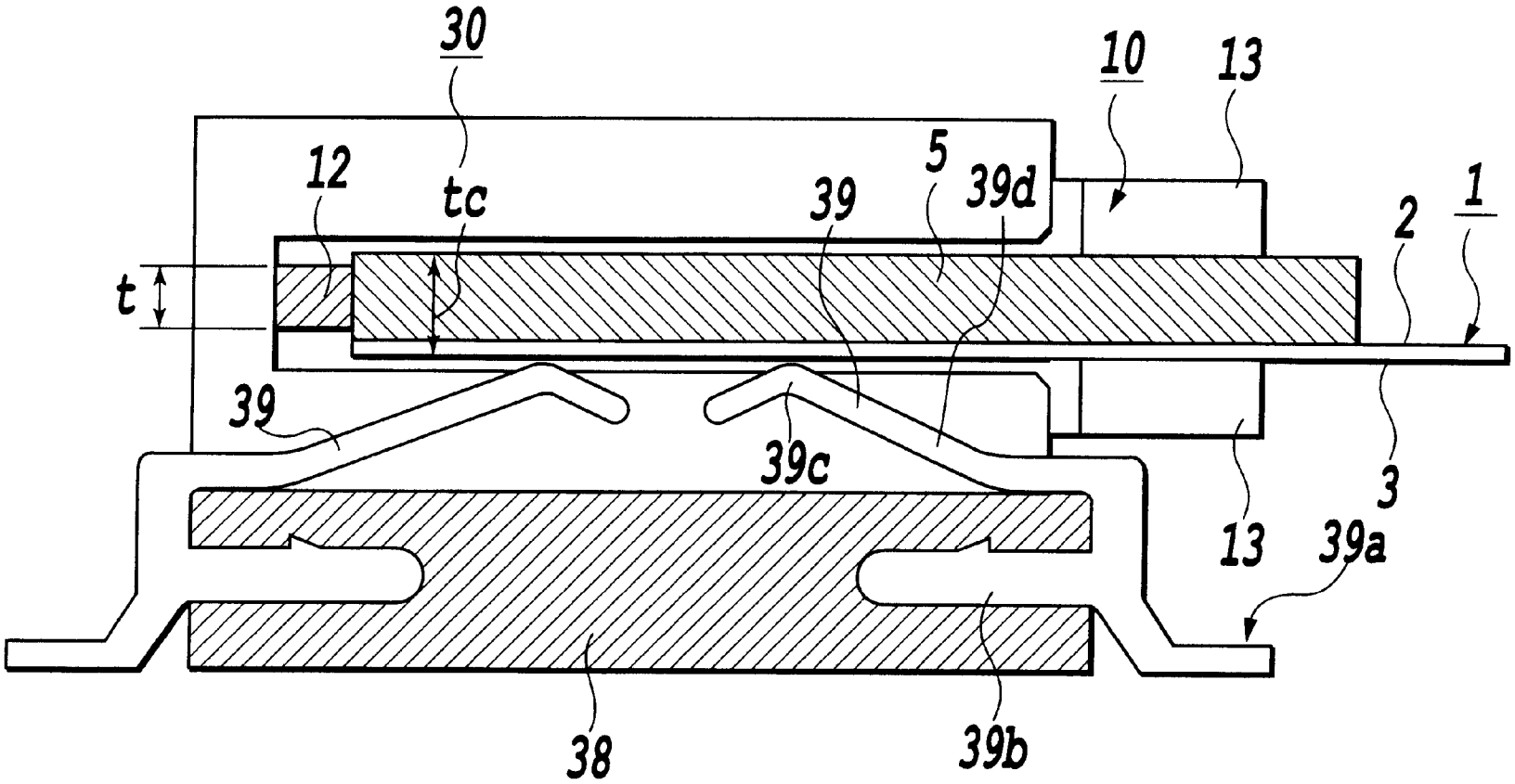
FIG. 4 is a vertical cross section of the cable connector according to the first embodiment of the invention.

FIG. 1 is a perspective view showing an overall construction of the cable connector according to the first embodiment. FIG. 2 is a perspective view showing a cable and an adapter, i.e., a locking body, in the cable connector of the first embodiment. FIG. 3 is a horizontal cross section of the cable connector of the first embodiment. FIG. 4 is a vertical cross section of the cable connector of the first embodiment.

As shown in these figures, the cable connector for electrically connecting a flat cable 1 to a printed circuit board comprises a locking body 10 removably attached to the flat cable 1 and a receptacle 30 into which the flat cable 1 attached with the locking body 10 is inserted.

The flat cable 1 uses an FPC cable 1 in this case.

The flat cable 1 has a microstrip line structure which has a ground plane 2 formed on one surface and a signal plane 3 on the other. On the signal plane 3 side at opposite ends (only one end is shown) of the cable 1 are formed contact portions (openings in an overlay) 4 in which signal lines and surface ground lines are partly exposed (see FIG. 11). The ground plane 2 at the ends of the cable 1 is directly bonded with a metal reinforcement plate 5 of the same width as the cable 1 by a conductive adhesive. The top and bottom surfaces of the cable 1, excluding the contact portions 4 and the parts of the ground plane 2 attached with the metal reinforcement plates 5, are covered with a coating material (not shown), such as thermosetting resist and polyimide film.

The metal reinforcement plate 5 has rectangular side projections 6 protruding sideways outwardly from both sides thereof near its proximal end. At the center of a distal end of the metal reinforcement plate 5 a rectangular front projection 7 protrudes forwardly.

Because the conductive reinforcement plate 5 is stacked on the ground plane 2 of the ends of the cable 1, not only can the end of the cable 1 be reinforced but it can also be connected to ground through the conductive reinforcement plate 5 which is received in a receptacle described later. The ground connection through a large contact area contributes to reducing electromagnetic noise.

The locking body 10 removably attached to the cable 1 is formed from an elastic insulating material such as resin. The locking body 10 has a pair of side frames 11, 11 and a front frame 12 connecting the front ends of the side frames 11.

These paired side frames 11 and the front frame 12 combine to form a roughly U-shaped, integral one-piece locking body 10. The side frames 11 are each formed with a grip portion 13 protruding sideways outwardly at the proximal end.

The side frames 11 are each formed with a guide groove 14 (FIG. 2) along which the side edges of the cable 1 (cable 1 + reinforcement plate 5) are guided to insert the cable 1 into the locking body 10. The guide grooves 14 extend from base end faces of the grip portions 13 to the front frame 12 against which the front end face of the cable 1 abuts. The guide grooves 14 are formed as through-holes (slits) 14*a* at other than the grip portions 13 so that the side edges of the cable 1 and the reinforcement plate 5 protrude sideways outwardly to be exposed.

The grip portions 13 each have an engagement hole 16 with which the side projection 6 of the cable 1 engages. These engagement holes 16 have lengths deeper than the heights b of the side projections 6 (FIG. 3) to provide spaces that allow the side frames 11 to be elastically displaced toward each other when the grip portions 13, with the locking body 10 attached to the cable 1, are pushed by fingers toward each other. For this purpose, the engagement holes 16 are formed as through-holes.

Because the locking body 10 is a U-shaped frame, the top and bottom surfaces of the cable 1+ reinforcement plate 5 are exposed between the side frames 11. The front frame 12 is arranged to connect portions corresponding to the guide grooves 14*a* of the side frames 11. The front frame 12 has formed at its center on the side engaging the cable 1 a recess 12*a* that receives the front projection 7 of the reinforcement plate 5.

As shown in FIG. 4, the thickness t of the front frame 12 is set smaller than the thickness tc of the front end of the cable 1 (in this embodiment, a cable thickness including a thickness of the reinforcement plate 5).

The side frames 11 of the locking body 10 each have a locking projection 15 protruding sideways. When the cable 1 attached with the locking body 10 is inserted into the receptacle 30, these locking projections 15 fit into locking holes 35 formed in the receptacle 30 to prevent the cable 1 attached with the locking body 10 from coming off. The locking projections 15 each have a tapered surface 15*a* for facilitating their insertion into the receptacle 30 and a locking surface 15*b* for preventing retraction.

The receptacle 30 comprises a housing 37 integrally formed of an insulating material such as resin and a plurality of contact terminals 39 securely press-fitted into a housing base plate 38.

Each of the contact terminals 39 has a contact portion 39*a* soldered to a printed circuit board, a press-fit stationary portion 39*b* press-fitted into the housing base plate, and a cantilevered spring portion 39*d* having a contact portion 39*c*. These contact terminals 39 engage with contact portions of the signal lines and the surface ground lines of the flat cable 1.

The receptacle 30 has a slot (cable accommodating hole) 31 into which inserted is the cable fitted with the locking body 10.

The slot 31 has a shape corresponding to that of the cable 1 fitted with the locking body 10. That is, the slot 31 has a pair of guide grooves 32 for guiding the edges of the cable 1 and reinforcement plate 5 protruding sideways from the side frames 11 of the locking body 10, side frame holes 33 into which inserted is the side frames 11 of the locking body 10, and a main slot 34 into which inserted is the cable 1 and reinforcement plate 5 exposed between the side frames 11.

Left and right sidewalls of the receptacle 30 are formed with locking holes 35 in which the locking projections 15 of the side frames 11 of the locking body 10 engage. Although the locking holes 35 are formed as through-holes in this embodiment, they may be bottomed recesses as long as the locking projection 15 can be locked there.

In the above construction, the flat cable 1 is connected to the receptacle 30 in the following procedure. First, the locking body 10 is attached to the cable 1 that is already mounted with the reinforcement plate 5. That is, the cable 1 is inserted along the guide grooves 14 of the locking body 10 from the opening side of the locking body 10 until the side projections 6 of the reinforcement plate 5 fit into the engagement holes 16 in the grip portions 13 of the locking body 10.

Next, the cable 1 attached with the locking body 10 is inserted into the slot 31 of the receptacle 30. The insertion causes the contact portions 4 of the signal lines and surface ground lines of the flat cable 1 to engage the corresponding contact terminals 39 in the receptacle 30, thus establishing an electrical connection between the flat cable 1 and the printed circuit board through the receptacle 30. At the same time, the locking projections 15 protruding sideways from the side frames 11 of the locking body 10 fit into the locking holes 35 formed in the receptacle 30, thereby preventing the flat cable 1 attached with the locking body 10 from coming off.

Because this flat cable connector has the front frame 12 and side frames 11 of the locking body 10 so sized that when the locking body 10 is attached to the flat cable 1, the side portions of the flat cable 1 and reinforcement plate 5 protrude sideways from the slits 14*a* of the paired side frames 11, the cable 1 as it is inserted into the receptacle 30 is positioned laterally (in the direction of pitch of the signal lines) with respect to the receptacle 30 by the engagement relationship between the sidewall surfaces of the guide grooves 32 of the slot 31 and the side surfaces of the cable 1 itself (more precisely, the side surfaces of the cable 1 and reinforcement plate 5) projecting sideways from the side frames 11 of the locking body 10.

Because in this flat cable connector the thickness t of the front frame 12 is set smaller than the thickness tc of the front end of the flat cable 1 including the reinforcement plate 5, the flat cable 1 is positioned vertically (in the direction of thickness) with respect to the receptacle 30 by the engagement relationship between the main slot 34 and the top and bottom surfaces of the flat cable 1 and reinforcement plate 5 exposed between the side frames 11, 11 of the locking body 10 and by the engagement relationship between the upper and lower wall surfaces of the guide grooves 32 of the receptacle 30 and the top and bottom surfaces of the flat cable 1 and reinforcement plate 5 projecting sideways from the side frames 11.

The dimensions of the side frame holes 33 of the receptacle 30 are set so that the side frames 11, 11 of the locking body 10 can be loosely inserted into the side frame holes 33.

With this flat cable connector therefore, the horizontal and vertical positioning of the contact portions 4 of the flat cable 1 with respect to the contact terminals 39 of the receptacle 30 can be achieved by the side surfaces and the top and bottom surfaces of the flat cable 1 including the reinforcement plate 5 without being influenced by the locking body 10. This prevents a possible degradation of the positioning accuracy when the flat cable 1 attached with the locking body 10 is inserted into the receptacle 30.

Next, when the cable 1 is to be disconnected from the receptacle 30, the grip portions 13 of the side frames 11 are held between fingers and applied with a force that tends to bring them toward each other. Because the engagement holes 16 in the grip portions 13 are provided with spaces that allow the grip portions 13 to be moved toward each other, the application of such a force to the grip portions 13 causes them to move toward each other, thus elastically displacing a pair of cantilevered side frames 11 toward each other. As a result of this elastic displacement, the locking projections 15 disengage from the locking holes 35 of the receptacle 30. In this state, pulling the locking body 10 and the flat cable 1 retracts them from the receptacle 30.

As described above, because in this embodiment the locking body 10 is removably attached to the flat cable 1, the flat cable can be held firmly in the receptacle without complicating the construction of the receptacle. Further, because the locking structure of this embodiment exposes the side portions and the top and bottom surfaces of the cable, the vertical and horizontal positioning of the contact portions 4 of the flat cable 1 with respect to the contact terminals 39 of the receptacle 30 can be realized reliably and precisely.

[Second Embodiment]

Next, the second embodiment of this invention will be described by referring to FIG. 5 through FIG. 12.

Figure 5:
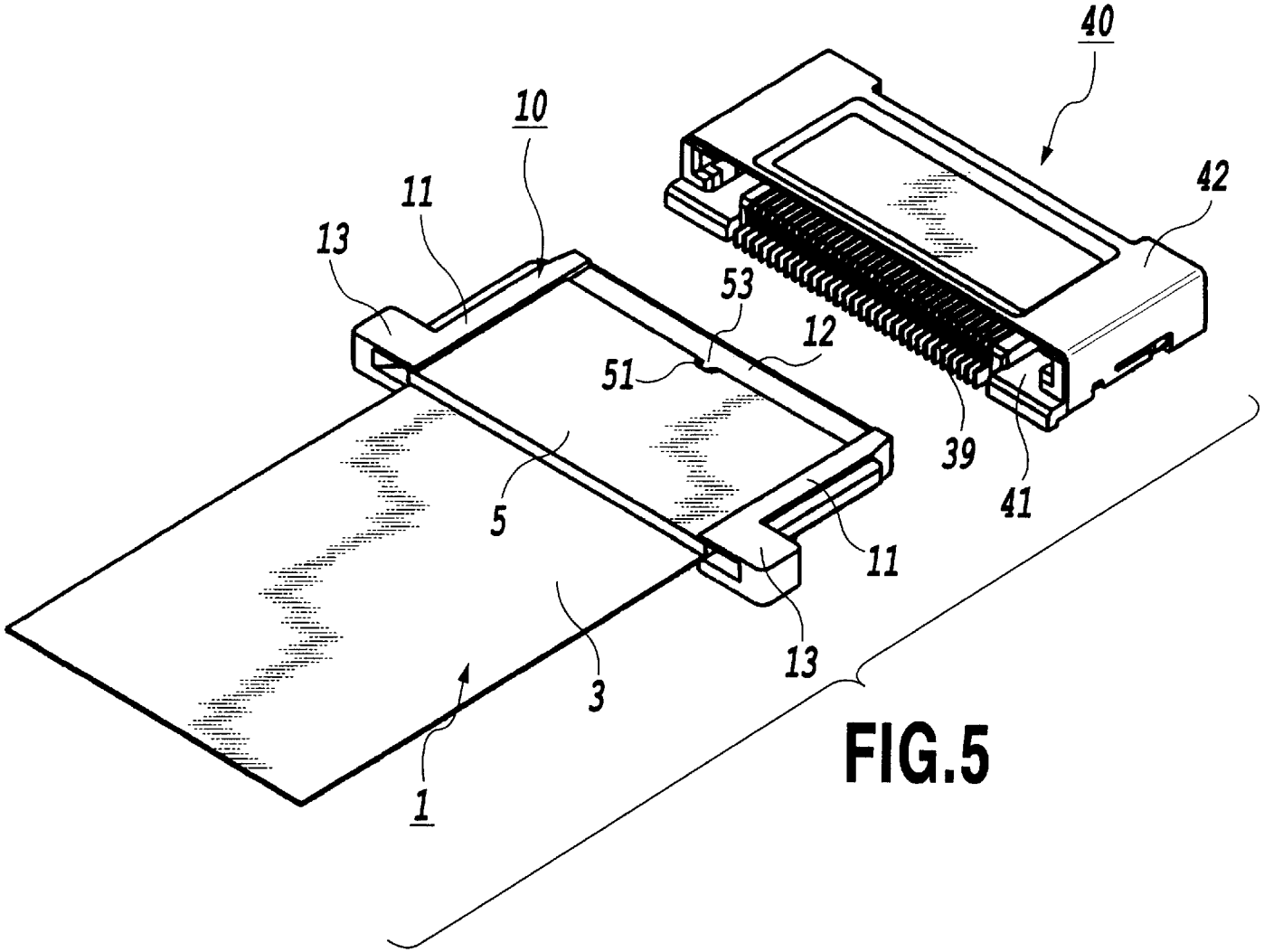
FIG. 5 is a perspective view showing an overall construction of a cable connector according to a second embodiment of the invention before a cable is connected.
Figure 6:
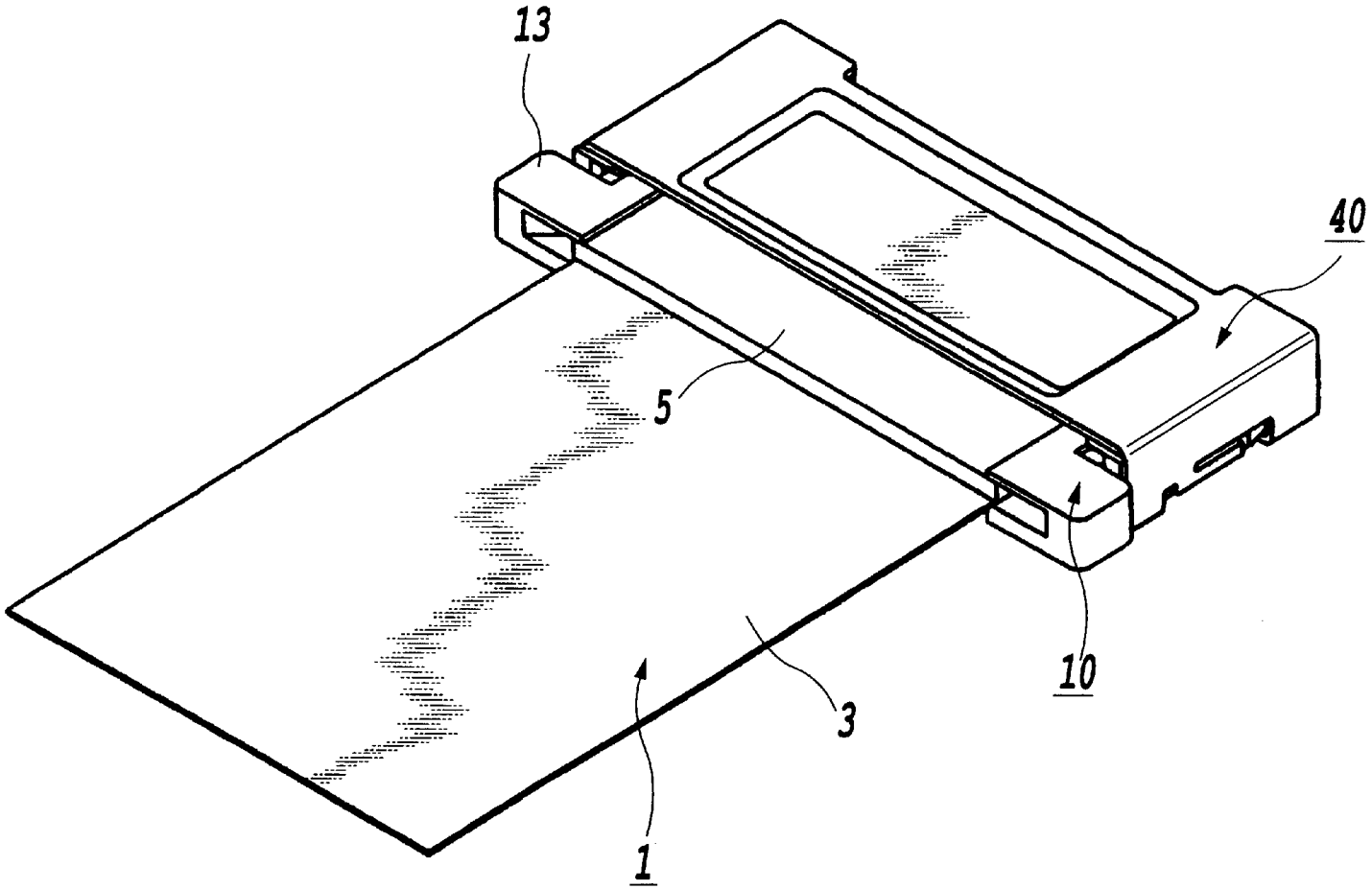
FIG. 6 is a perspective view showing an overall construction of the cable connector according to the second embodiment of the invention when the cable is connected.
Figure 7:
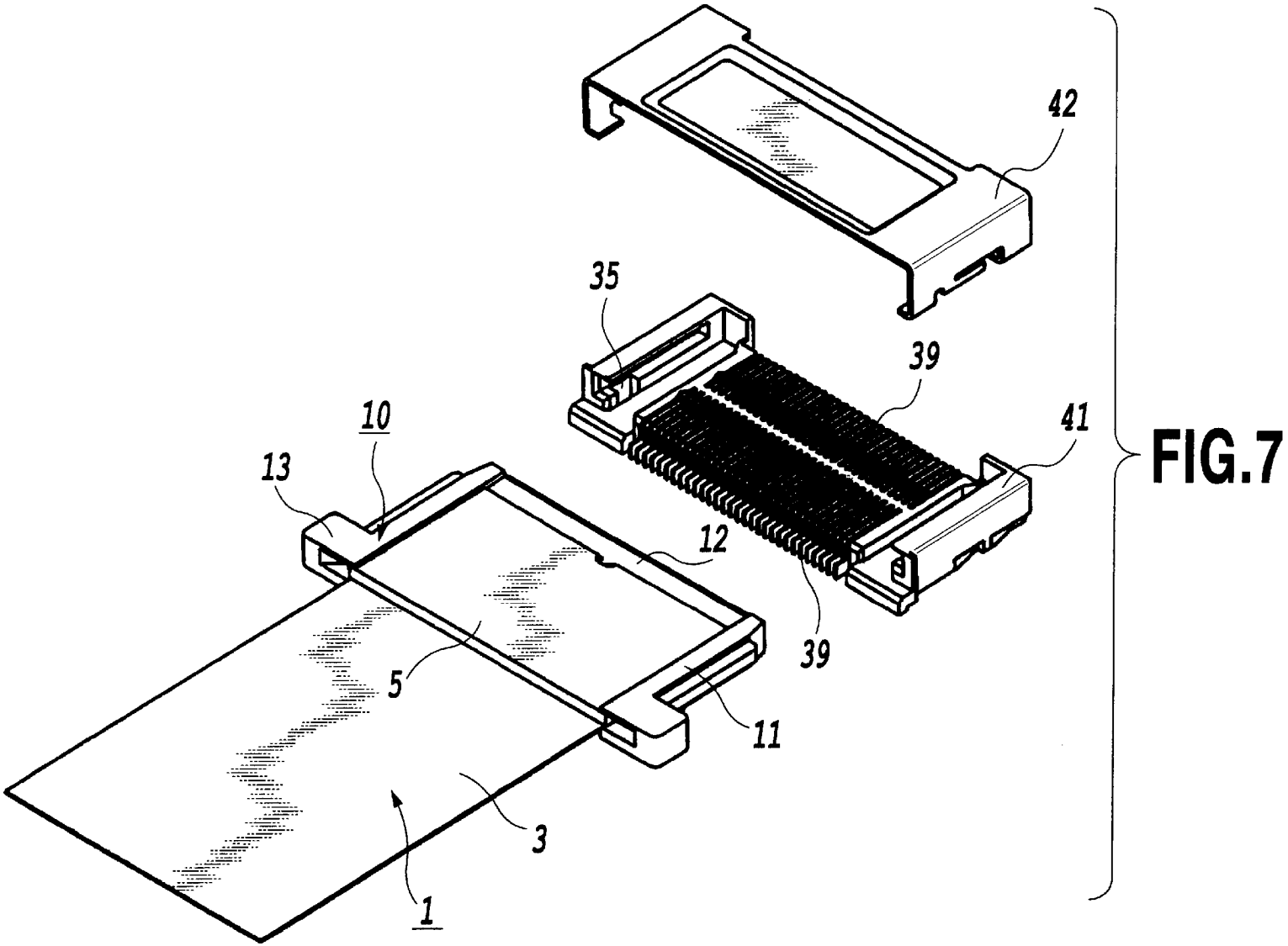
FIG. 7 is a perspective view showing an overall construction of the cable connector according to the second embodiment of the invention with a receptacle disassembled.
Figure 8:
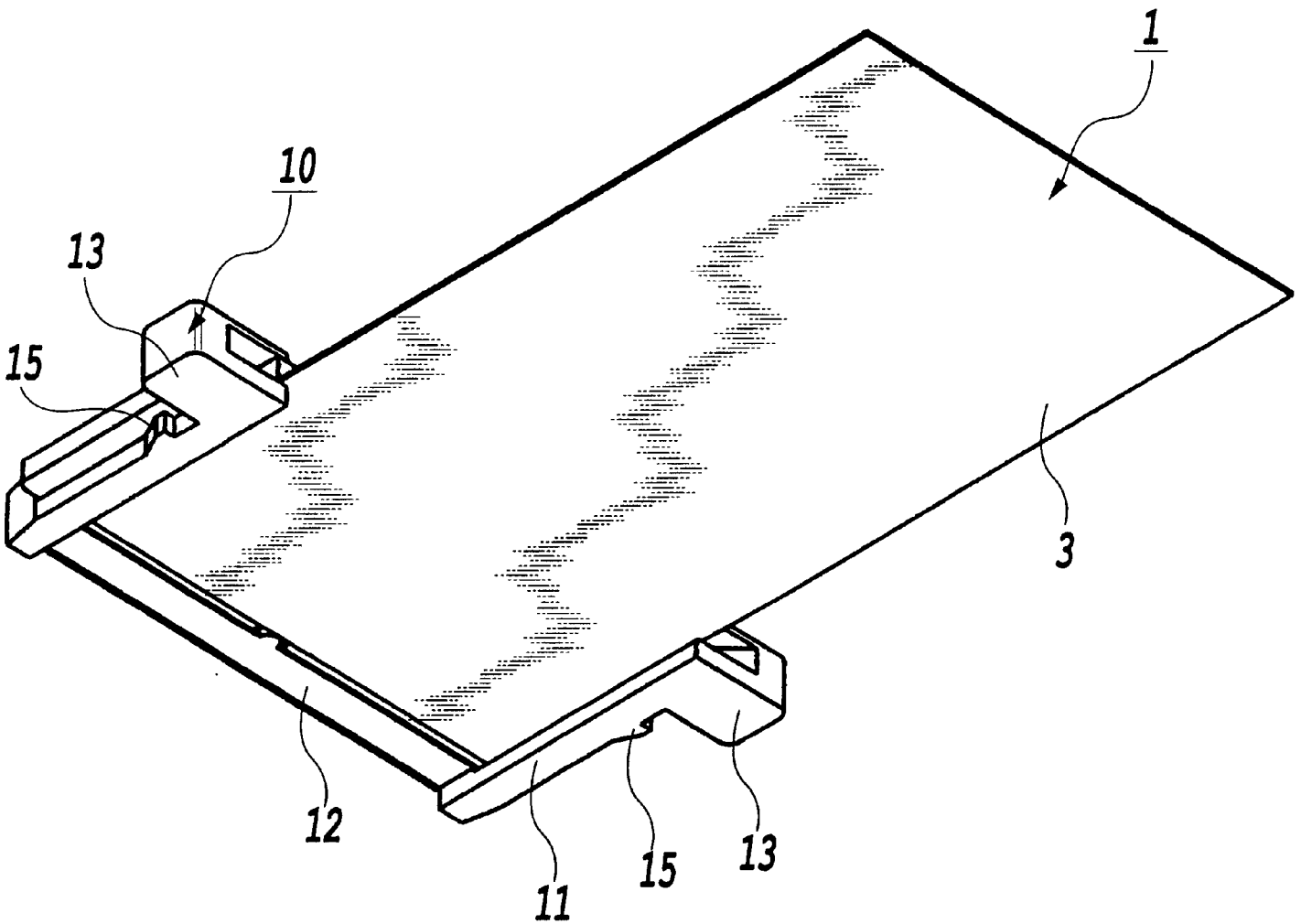
FIG. 8 is a perspective view showing a cable and a locking body according to the second embodiment of the invention.
Figure 9:
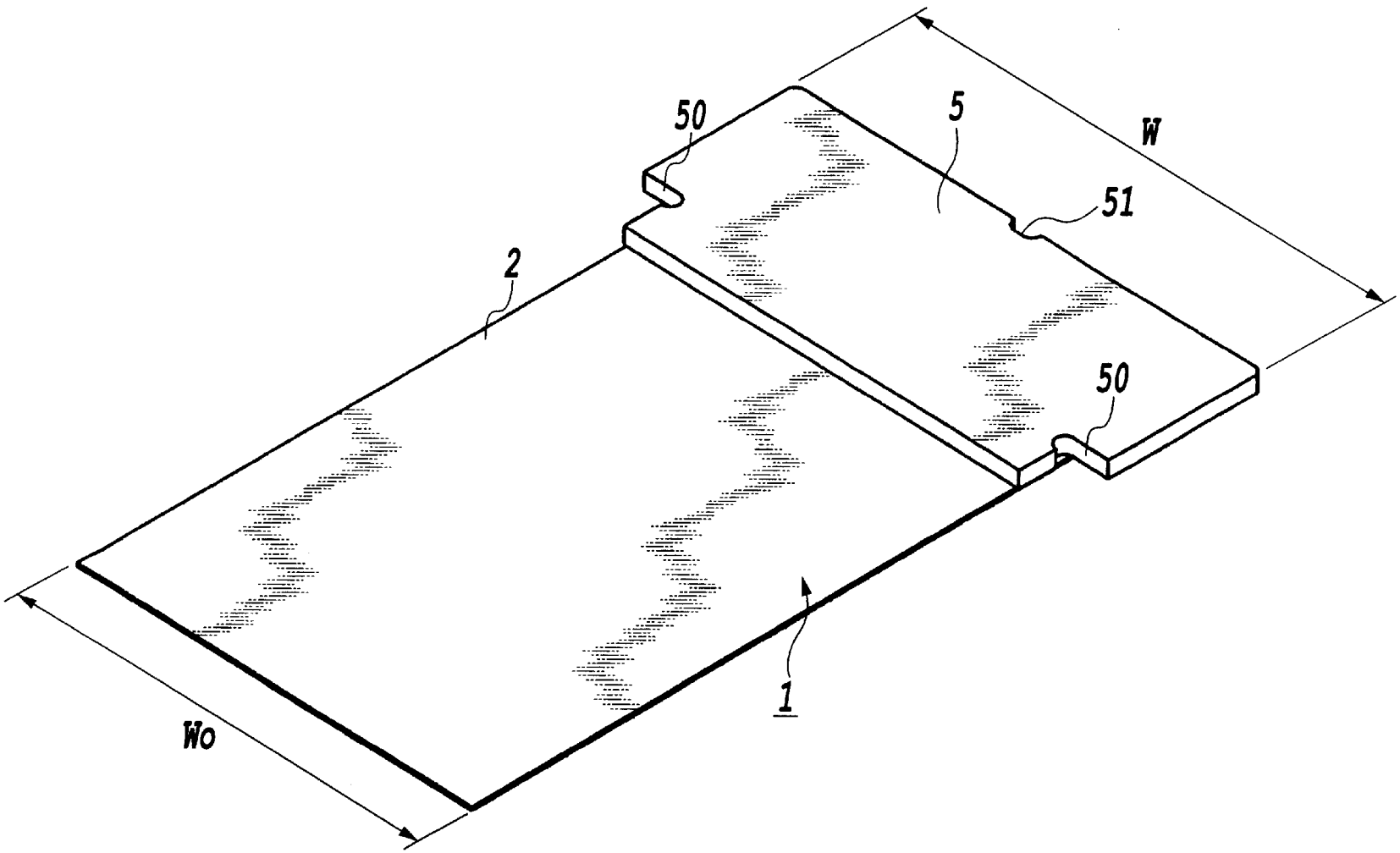
FIG. 9 is a perspective view of the cable according to the second embodiment of the invention.
Figure 10:
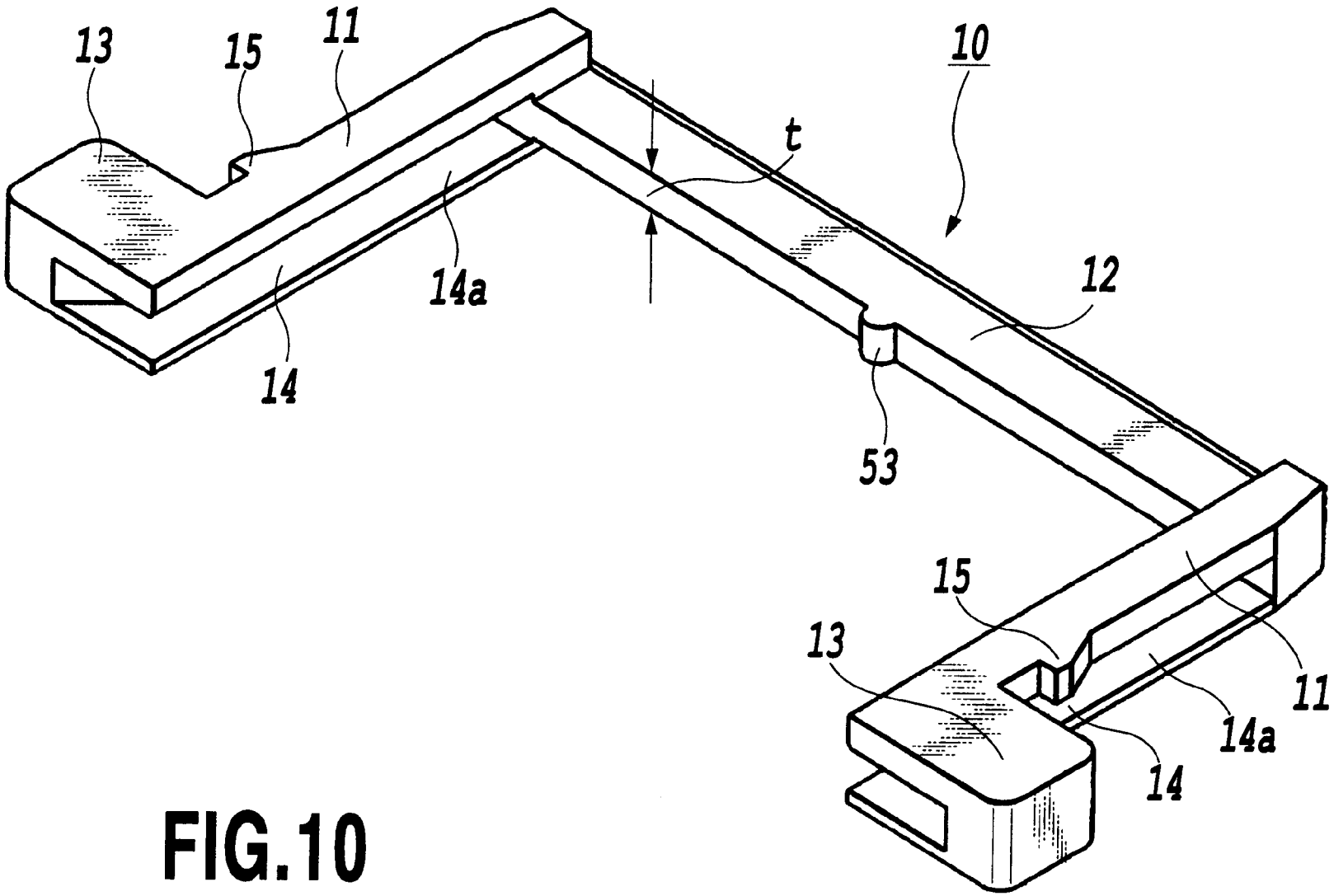
FIG. 10 is a perspective view of the locking body according to the second embodiment of the invention.
Figure 11:
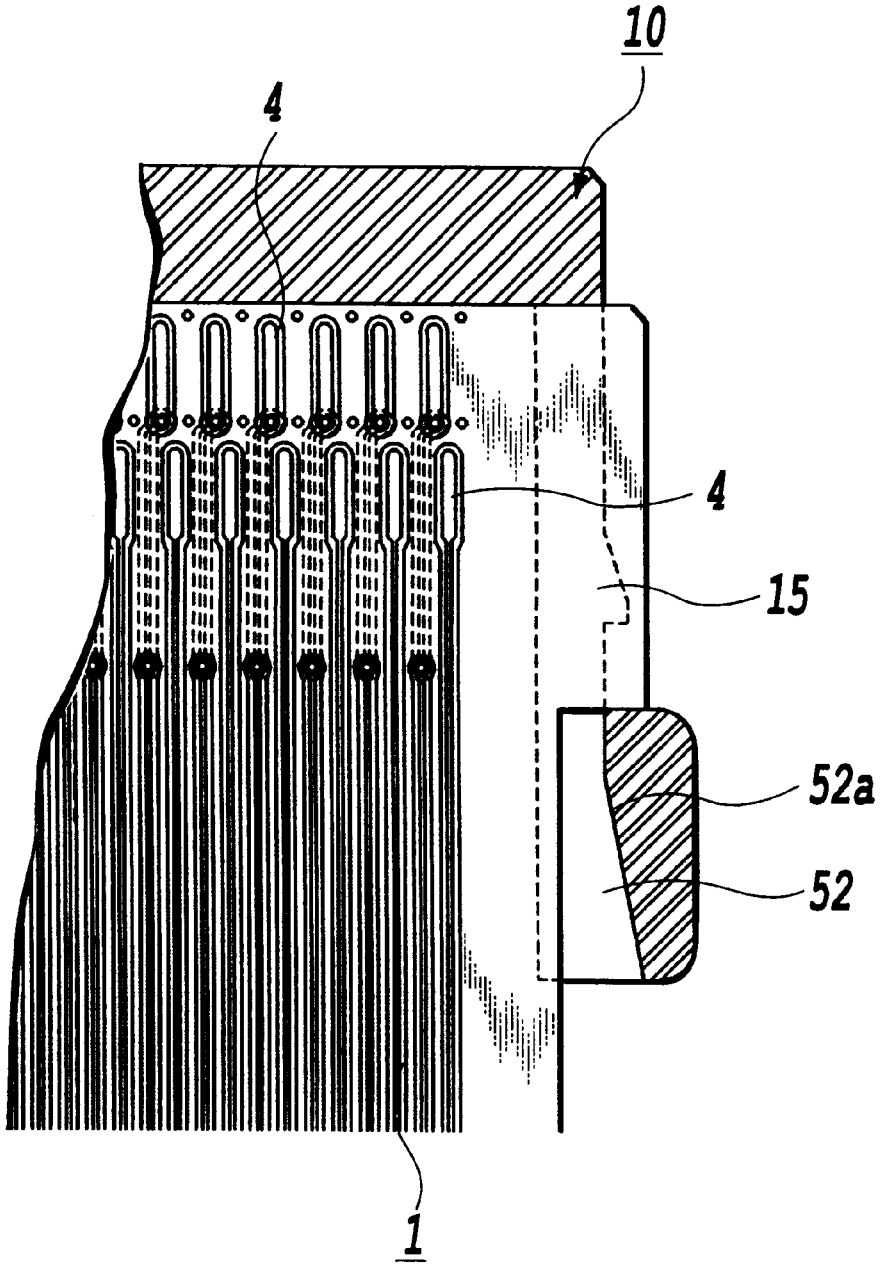
FIG. 11 is a partial horizontal cross section showing the cable and the locking body according to the second embodiment of the invention.
Figure 12:
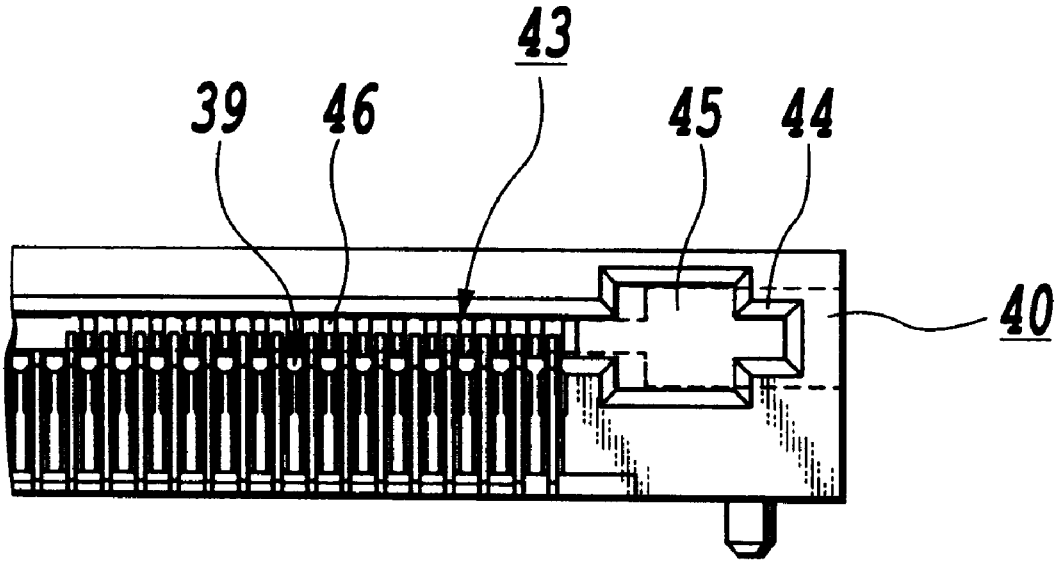
FIG. 12 is a partial front view of a receptacle according to the second embodiment of the invention.
Figure 13:
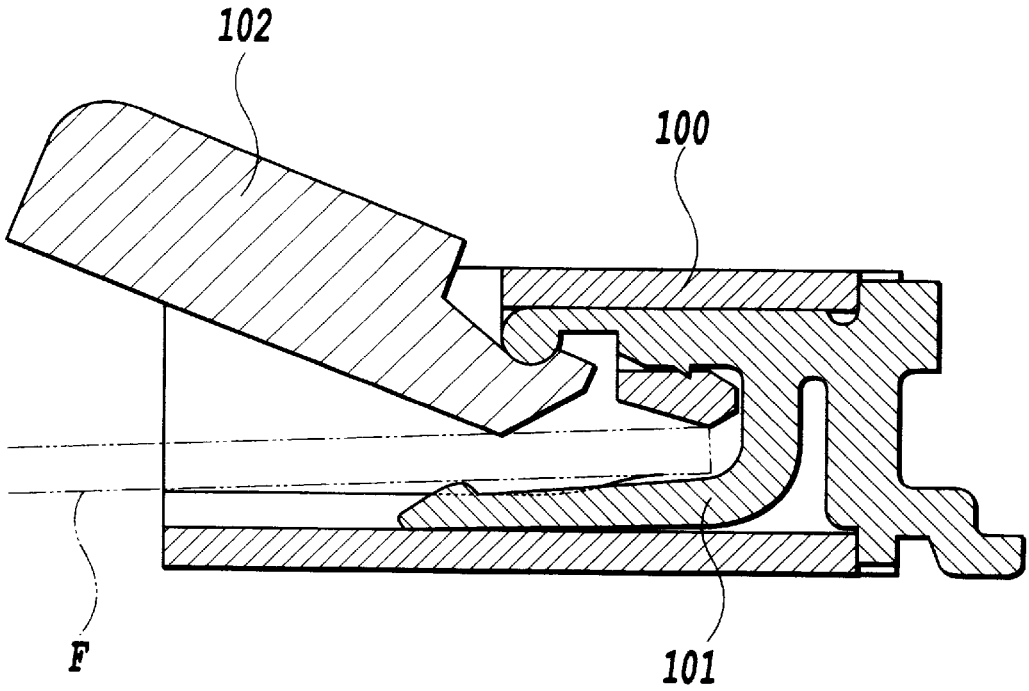
FIG.13 PRIOR ART
FIG. 13 is a schematic view showing a conventional technology.

FIG. 5 is a perspective view showing an overall construction of the cable connector before a flat cable is connected. FIG. 6 is a perspective view showing an overall construction of the cable connector when the cable is connected. FIG. 7 is a perspective view showing an overall construction of the cable connector with the receptacle disassembled. FIG. 8 is a perspective view showing the cable with a locking body. FIG. 9 is a perspective view of the cable. FIG. 10 is a perspective view of the locking body. FIG. 11 is a partial horizontal cross section of the cable and the locking body. FIG. 12 is a partial front view of the receptacle.

The cable connector of the second embodiment also comprises a locking body 10 removably attached to the flat cable 1, and a receptacle 40 for receiving the flat cable 1 attached with the locking body 10.

The flat cable 1 has a microstrip line structure, as described earlier, with one surface formed with a ground plane 2 and the other surface with a signal plane 3. On the signal plane 3 side at opposite ends of the cable 1 are formed contact portions 4 in which signal lines and surface ground lines are partly exposed (see FIG. 11). The ground plane 2 at the ends of the cable 1 is bonded with a metal reinforcement plate 5.

In the second embodiment, the width W of the reinforcement plate 5 is set larger than the width $W_0$ of the cable 1, as shown in FIG. 9. The width of the reinforcement plate 5 on the proximal end side is almost equal to the width $W_0$ of the cable 1, and there is a stepped portion 50 near the proximal end of the reinforcement plate 5.

The reinforcement plate 5 also has a recess (notch) 51 at the center of its distal end.

The locking body 10 comprises, as in the first embodiment, a pair of side frames 11, 11 and a front frame 12 connecting the front ends of the side frames 11. The side frames 11 each have a grip portion 13 on the proximal end side protruding sideways outwardly.

Each of the side frames 11 is formed with a guide groove 14 (FIG. 10) for guiding the side edges of the cable 1 (more precisely, including the reinforcement plate 5) in inserting the cable 1 into the locking body 10. The guide grooves 14 are formed as through-holes (slits) 14*a* at other than the grip portions 13 so that the side edges of the reinforcement plate 5 bonded on the cable 1 protrude sideways outwardly to be exposed.

The guide grooves 14 in the grip portions 13 are each formed with a space 52 (see FIG. 11) that allows the side frames 11 to be elastically displaced toward each other when the grip portions 13 of the locking body 10 are pushed toward each other by fingers. The inner wall surface of the space 52 is formed as a tapered surface 52*a* corresponding to the elastic deformation of each of the side frames 11.

The front frame 12 of the locking body 10, as in the previous embodiment, connects portions corresponding to the guide grooves 14*a* of the side frames 11. The front frame 12 has formed at its center on the side engaging the cable 1 a projection 53 that fits in the recess 51 formed in the reinforcement plate 5. The thickness t of the front frame 12 (FIG. 10) is set smaller than the thickness tc of the front end of the cable 1 (in this embodiment, the thickness of the cable plus the reinforcement plate 5), as described earlier.

The side frames 11 of the locking body 10 are each formed with a locking projection 15 protruding sideways outwardly (FIG. 10). When the cable 1 attached with the locking body 10 is inserted into the receptacle 40, these locking projections 15 fit into locking holes 35 (FIG. 7) formed in the receptacle 40 to prevent the flat cable 1 attached with the locking body 10 from coming off.

Next, the housing of the receptacle 40 comprises a housing body 41 formed from an insulating material such as resin and a metal shell 42 covering the top surface of the housing body 41. A base plate of the housing body 41 is securely attached with a plurality of contact terminals 39 by press-fit.

The receptacle 40 has a cable accommodating portion (slot) 43 into which inserted is the cable 1 attached with the locking body 10.

The slot 43 has a shape corresponding to the cable 1 attached with the locking body 10. That is, as shown in FIG. 12, the slot 43 has a pair of guide grooves 44 for guiding the side surfaces of the reinforcement plate 5 protruding sideways from the side frames 11 of the locking body 10, side frame holes 45 in which the side frames 11 of the locking body 10 are inserted, and a main slot 46 between the housing body 41 and the shell 42 into which inserted are the reinforcement plate 5 and cable 1 exposed between the side frames 11.

Left and right sidewalls of the housing body 41 are formed with locking holes 35 in which the locking projections 15 of the side frames 11 of the locking body 10 engage.

In this construction, the cable 1 is connected to the receptacle 40 in the following procedure. First, as in the previous embodiment, the locking body 10 is attached to the cable 1. That is, the cable 1 is inserted along the guide grooves 14 of the locking body 10 from the opening side of the locking body 10 until the stepped portions 50 of the reinforcement plate 5 on the cable 1 engage the grip portions 13 of the locking body 10. The engagement of the stepped portions 50 and the grip portions 13 prevents the locking body 10 from coming off.

Next, the cable 1 mounted with the locking body 10 in this manner is then inserted into the slot 43 of the receptacle 40. With the cable 1 inserted, the contact portions 4 of the signal lines and the surface ground lines of the flat cable 1 engage with the corresponding contact terminals 39 in the receptacle 40, thus making electrical connections between the flat cable 1 and the printed circuit board through the receptacle 40. At the same time, the locking projections 15 formed at the sides of the side frames 11 of the locking body 10 fit into the locking holes 35 formed in the receptacle 40, thereby preventing the flat cable 1 attached with the locking body 10 from coming off.

When the cable 1 is to be disconnected from the receptacle 40, the grip portions 13 of the side frames 11 are held between the fingers and applied with a force that tends to bring them toward each other. Because the grip portions 13 are formed with the spaces 52, the application of such a force to the grip portions 13 causes them to move toward each other, thus elastically displacing a pair of cantilevered side frames 11 toward each other. As a result of this elastic displacement, the locking projections 15 disengage from the locking holes 35 of the receptacle 40. In this state, pulling the locking body 10 and the cable 1 retracts them from the receptacle 40.

In the second embodiment, too, the cable 1 as it is inserted into the receptacle 40 is positioned laterally (in the direction of pitch of the signal lines) with respect to the receptacle 40 by the engagement relationship between the sidewall surfaces of the guide grooves 44 of the slot 43 and the side surfaces of the reinforcement plate 5 projecting sideways from the side frames 11 of the locking body 10. Because the thickness t of the front frame 12 is set smaller than the thickness tc of the front end of the flat cable 1 including the reinforcement plate 5, the flat cable 1 is positioned vertically with respect to the receptacle 40 by the engagement relationship between the main slot 46 and the top and bottom surfaces of the reinforcement plate 5 and flat cable 1 exposed between the side frames 11, 11 of the locking body 10 and by the engagement relationship between the upper and lower wall surfaces of the guide grooves 44 of the receptacle 40 and the top and bottom surfaces of the reinforcement plate 5 projecting sideways from the side frames 11. The dimensions of the side frame holes 45 of the receptacle 40 are set so that the side frames 11, 11 of the locking body 10 can be loosely inserted into the side frame holes 45.

Hence, in the second embodiment also, the horizontal and vertical positioning of the contact portions 4 of the flat cable 1 with respect to the contact terminals 39 of the receptacle 40 can be achieved by the side surfaces and the top and bottom surfaces of the reinforcement plate 5 integrally mounted on the cable 1 without being influenced by the locking body 10. This prevents a possible degradation of the positioning accuracy when the flat cable 1 attached with the locking body 10 is inserted into the receptacle 40.

Further, in the second embodiment too, because the locking body 10 is removably coupled to the flat cable 1, the flat cable can be held firmly in the receptacle without complicating the construction of the receptacle.

In this invention, if certain levels of strength and thickness can be secured at the ends of the flat cable as by a coating material, the reinforcement plate 5 may be omitted.

The connector of this invention can be applied to printed circuit boards, semiconductor package mounting boards and MCM (multichip module) boards used in personal computers, printers, displays, peripheral devices for FDD, HDD and memory cards, and cellular phones, car navigation equipment, video cameras and CD players, and can also be applied to automobile- and satellite-related devices.

The present invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. A flat cable connector for electrically connecting a flat cable having contact portions of a plurality of signal lines exposed at ends of one of its surfaces, the flat cable connector comprising:

a roughly U-shaped adapter removably attached to an end of the flat cable, the adapter having a pair of side frames and a front frame connecting front ends of the paired side frames, wherein each side frame of the pair of side frames has a slit for receiving a side edge of the flat cable and a locking portion; and a receptacle having a housing securely installed therein a plurality of contact terminals adapted to engage the contact portions of the flat cable, said housing being formed with engagement portions engaged by said locking portions and with a slot into which inserted is the flat cable attached with said adapter; and wherein said receptacle holds said flat cable attached with said adapter in the housing in such a manner that said contact portions of said flat cable engage with said plurality of contact terminals.

2. A flat cable connector according to claim 1, wherein said cable has a conductive reinforcement plate stacked at a cable end on a surface opposite the surface where said contact portions are exposed.

3. A flat cable connector according to claim 2, wherein the front frame of said adapter has a thickness smaller than that of the end of the flat cable including said reinforcement plate so that when the adapter is attached to said flat cable, the front frame is arranged within a range of the thickness of the end of said flat cable including said reinforcement plate.

4. A flat cable connector according to claim 3, wherein said reinforcement plate has a width larger than that of said flat cable so that when said adapter is attached to said flat cable, side portions of said reinforcement plate protrude sideways outwardly from the slits of said paired side frames.

5. A flat cable connector according to claim 2, wherein said adapter has the front frame and the side frames so sized that when said adapter is attached to said flat cable, side portions of said reinforcement plate and said flat cable protrude sideways outwardly from the slits of said paired side frames.

6. A flat cable connector according to claim 2, wherein said reinforcement plate has a width larger than that of said flat cable so that when said adapter is attached to said flat cable, side portions of said reinforcement plate protrude sideways outwardly from the slits of said paired side frames.

7. A flat cable connector according to claim 2, wherein the paired side frames of said adapter each have a grip portion protruding sideways outwardly on a proximal end side thereof, and the grip portions each have a space between them and side surfaces of the reinforcement plate and the flat cable which enables the associated grip portion to move sideways when said adapter is attached to the flat cable, and wherein the locking portions of the paired side frames are unlocked from the engagement portions of the receptacle by moving the grip portions sideways.

8. A flat cable connector according to claim 2, wherein the slot in said receptacle is formed with guide grooves for guiding side edges of said reinforcement plate for the flat cable attached with the adapter and of the flat cable.

9. A flat cable connector according to claim 1, wherein the front frame of said adapter has a thickness smaller than that of the end of the flat cable so that when said adapter is attached to said flat cable, the front frame is arranged within a range of the thickness of the end of said flat cable.

10. A flat cable connector according to claim 1, wherein said adapter has the front frame and the side frames so sized that when said adapter is attached to said flat cable, side portions of the flat cable protrude sideways outwardly from the slits of said paired side frames.

11. A flat cable connector according to claim 1, wherein the paired side frames of said adapter each have a grip portion protruding sideways outwardly on a proximal end side thereof, and the grip portions each have a space between them and side surfaces of said flat cable which enables the associated grip portion to move sideways when said adapter is attached to the flat cable, and wherein the locking portions of the paired side frames are unlocked from the engagement portions of the receptacle by moving the grip portions sideways.

12. A flat cable connector according to claim 1, wherein the slot in said receptacle is formed with guide grooves for guiding side edges of the flat cable attached with the adapter.

* * * * *